United States Patent [19]

Iwao

[11] Patent Number: 4,473,290

[45] Date of Patent: Sep. 25, 1984

[54] TONER IMAGE FIXING DEVICE

[75] Inventor: Soichi Iwao, Okazaki, Japan

[73] Assignee: Minolta Camera Kabushiki Kaisha, Osaka, Japan

[21] Appl. No.: 363,782

[22] Filed: Mar. 31, 1982

[30] Foreign Application Priority Data

Apr. 13, 1981 [JP] Japan ..... 56-55904

[51] Int. Cl.[3] ..... G03G 15/20

[52] U.S. Cl. ..... 355/3 FU; 219/216; 432/60

[58] Field of Search ..... 355/3 FU; 219/216, 388, 219/469; 432/60

[56] References Cited

U.S. PATENT DOCUMENTS

| | | | |
|---|---|---|---|
| 3,166,893 | 1/1965 | Sherwood | 337/120 X |
| 3,256,002 | 6/1966 | Hudson | 355/9 X |
| 3,291,466 | 12/1966 | Aser et al. | 263/6 |
| 3,324,791 | 6/1967 | Cassano et al. | 271/274 X |
| 3,331,592 | 7/1967 | Cassano et al. | 355/3 FU |
| 3,452,181 | 6/1969 | Stryjewski | 355/3 FU |
| 3,498,596 | 3/1970 | Moser | 219/388 |
| 3,539,161 | 11/1970 | Byrne | 219/388 X |
| 3,754,819 | 8/1973 | Braun | 355/3 FU |
| 3,810,776 | 5/1974 | Banks et al. | 219/216 X |
| 3,834,861 | 9/1974 | McCarroll | 219/216 X |
| 4,162,847 | 7/1979 | Brandon | 355/3 FU |
| 4,272,666 | 6/1981 | Collin | 219/216 |
| 4,279,496 | 7/1981 | Silverberg | 355/3 |
| 4,367,690 | 1/1983 | Sakaguchi et al. | 432/60 X |

FOREIGN PATENT DOCUMENTS

| | | | |
|---|---|---|---|
| 632 | 2/1979 | European Pat. Off. | 432/228 |

OTHER PUBLICATIONS

*IEEE Transactions on Industry Applications*, "High Force Linear Actuator", Peter G. Berg, pp. 50–57, vol. IA-9, No. 1, Jan./Feb. 1973.

*Primary Examiner*—R. L. Moses

*Attorney, Agent, or Firm*—Wenderoth, Lind & Ponack

[57] ABSTRACT

A toner image fixing device for fixing a toner image carried on a support material onto the support material through heat fusing includes a fixing roller provided with a heating element and a pressure roller arranged to contact, under pressure, the fixing roller for passing the support material between the fixing roller and the pressure roller. The toner image fixing device further includes a contact and spacing mechanism for causing the pressure roller selectively to contact or to be spaced from the fixing roller through utilization of expansion and contraction of an object or substance following turning-on and turning-off of the power supply.

6 Claims, 4 Drawing Figures

TONER IMAGE FIXING DEVICE

BACKGROUND OF THE INVENTION

1. Field of the Invention

The present invention generally relates to a fixing device and more particularly, to a contact and spacing mechanism of a pressure roller in a toner image fixing device for use, for example, in an electrophotographic copying apparatus, arranged to pass a toner image carrying support material, such as copy paper or the like, between a fixing roller and the pressure roller so as to fix the toner image onto the support material.

2. Description of the Prior Art

Conventionally, for a contact and spacing mechanism of a pressure roller for the toner image fixing device of the above described type, there have been employed arrangements which employ a clutch or solenoid or a combination of both for practical applications.

The known contact and spacing mechanisms of the pressure roller as described above, however, have problems in that, in the case where a driving power source is turned off during pressure contact of the pressure roller with the fixing roller, inertia of motor or weight of the pressure roller must be relied upon for the releasing of the contact force, and thus, an excessively large torque tends to be applied to bearing portions, with a consequent unstable functioning of the mechanism on the whole.

SUMMARY OF THE INVENTION

Accordingly, an essential object of the present invention is to provide an improved toner image fixing device which is capable of positively effecting contact and spacing functions of a pressure roller with respect to a fixing roller through on/off operation of a power supply, and has a contact and spacing mechanism for the pressure roller simple in construction and easy to control.

Another important object of the present invention is to provide an improved toner image fixing device of the above described type which is accurate and stable in functionings at high reliability, and can be readily incorporated into various copying apparatuses or the like at low cost.

In accomplishing these and other objects, according to one preferred embodiment of the present invention, there is provided a toner image fixing device for fixing a toner image carried on a support material onto the support material through heat fusing, which includes a fixing roller provided with a heating element and a pressure roller arranged to contact, under pressure, the fixing roller for passing the support material therebetween. The toner image fixing device further includes a contact and spacing mechanism for causing the pressure roller selectively to contact or to be spaced from the fixing roller through utilization of expansion and contraction of an object or substance following turning-on and turning-off of a power supply.

By the arrangement according to the present invention as described above, an improved toner image fixing device has been presented with substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE PREFERRED EMBODIMENT

Figure 1:
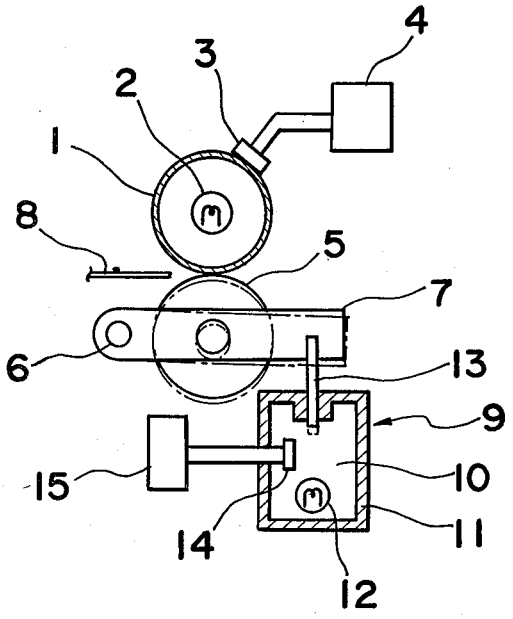
FIG. 1 is a schematic side elevational view, partly in section, of a toner image fixing device according to one preferred embodiment of the present invention.

Referring now to the drawings, there is shown in FIG. 1 a toner image fixing device according to one preferred embodiment of the present invention, which generally includes a fixing roller 1 having a heating element 2 incorporated therein which is energized upon turning-on of a power source (not shown) for heating the fixing roller 1 to be driven for rotation by a driving source (not shown), with the surface temperature of said fixing roller 1 being arranged to be detected by a temperature sensor 3 so as to be controlled to a predetermined fixing temperature by a temperature control circuit 4 coupled to said sensor 3, and a pressure roller 5 journalled on a support plate 7 which is pivotally connected, at its one end, to a shaft 6 so as to be selectively brought into contact with or spaced from said fixing roller 1 upon upward or downward pivotal movement of said support plate 7 about the shaft 6.

It is to be noted here that the construction of the toner image fixing device and those of the fixing roller and pressure roller described so far are conventional per se and therefore, detailed description thereof is abbreviated here for brevity. When a toner image support material, for example, a copy paper sheet 8 carrying the toner image thereon is passed through between the fixing roller 1 and the pressure roller 5 held in contact with each other under pressure, the toner image is fixed onto the copy paper sheet 8 in a known manner.

The toner image fixing device of FIG. 1 is further provided with a contact and spacing mechanism 9 utilizing expansion and construction of an object or substance, and directly related to the present invention.

More specifically, the contact and spacing mechanism 9 as described above includes a hermetically sealed vessel or container 11 containing therein an object or substance 10 having a comparatively large coefficient of volume expansion due to heating, for example, gases such as carbon dioxide, ammonia gas, etc., another heating element 12 disposed in the container 11 so as to be energized upon turning-on of the power source for heating the substance 10, a sliding member 13 slidably received at its one end in the container 11 for an upward displacement through volume expansion of the substance 10, a temperature sensor 14 provided in the container 11 for detecting the temperature of the substance 10 within said container, and a temperature control circuit 15 coupled to said temperature sensor 14 for controlling the temperature of the substance 10 detected by the sensor 14, to a temperature that will produce a predetermined degree of volume expansion of the substance 10, with the other upper end of the sliding member 13 being coupled to the corresponding other end of the pressure roller support plate 7 of the toner image fixing device.

Referring also to a diagram of FIG. 2 explanatory of temperature control for the fixing roller 1 and the contact and spacing mechanism 9 in the above embodiment of FIG. 1, functions thereof will be described in detail hereinbelow.

Figure 2:
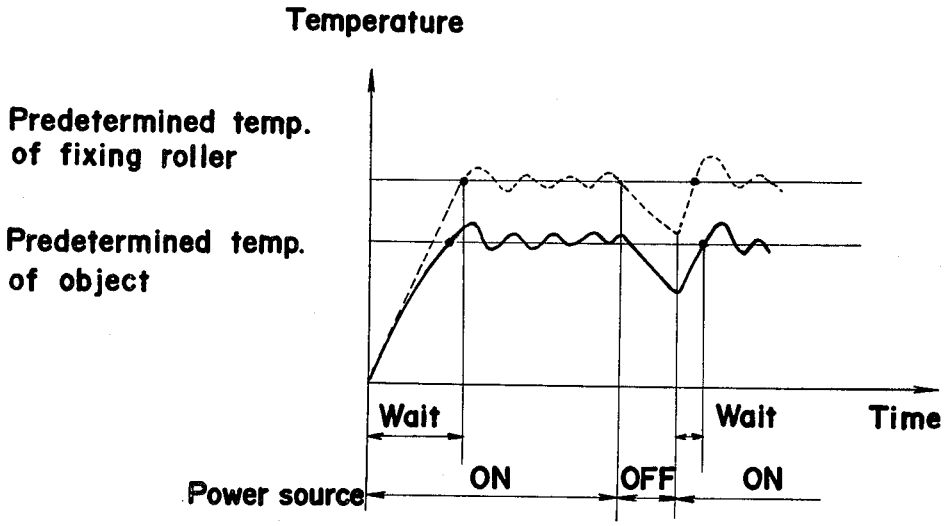
FIG. 2 is a graph explanatory of temperature control for the fixing device of FIG. 1.

In the arrangement of FIG. 1, upon turning-on of the power source, the heating element 2 in the fixing roller 1 and the heating element 12 in the hermetically sealed container 11 are respectively heated so that the temperature rises as shown in FIG. 2, whereby the substance 10 in the container 11 of the contact and spacing mechanism 9 is subjected to a volume expansion governed by the formula $PV=RT$ (wherein P is a pressure, V is a volume of gas, R is a gas constant, and T is an absolute temperature) so as to push up the sliding member 13 from a position shown by the dotted lines to that shown by the solid lines in FIG. 1. Thus, the pressure roller 5 is brought into contact with the fixing roller 1, in which case, the temperature of the substance 10 reaches a predetermined level and is detected by the temperature sensor 14 so as to subject the heating element 12 to on/off control by the temperature control circuit 15 for maintaining the substance 10 at the predetermined temperature.

Meanwhile, the surface temperature of the fixing roller 1 also reaches a predetermined level and detected by the temperature sensor 3 so as to subject the heating element 2 to on/off control by the temperature control circuit 4 for maintaining the fixing roller 1 at the predetermined temperature.

In the above state, the fixing device is held in a "wait" state until both of the above temperatures reach the predetermined level, and therefore, even when the fixing roller 1 has reached the predetermined temperature, the fixing device is still in the "wait" state unless the substance 10 in the contact and spacing mechanism 9 has reached the predetermined temperature.

After completion of fixing of the predetermined number of copy paper sheets 8, upon turning-off of the power supply, the heating elements 2 and 12 are turned off, with the substance 10 within the container 11 being cooled for contraction, and therefore, the sliding member 13 is lowered to release the pressure roller 5 from the pressure contact with the fixing roller 1 and thus, the pressure roller 5 spaced from the fixing roller 1 is returned to the original position shown by the chain-like lines in FIG. 1.

As is seen from the foregoing description, according to the embodiment of FIG. 1, it is so arranged that, by the turning-on of the power supply, the pressure roller 5 is brought into pressure contact with the fixing roller 1 through utilization of thermal expansion of the substance 10 within the container 11, while, by the turning-off of the power supply, said pressure roller 5 is spaced from the fixing roller 1 to be returned to the original position through utilization of cooling and contraction of the substance 10, and therefore, the contact and spacing mechanism 9 of the fixing device functions positively.

It should be noted here that in the arrangement of FIG. 1, for the substance 10 to be contained within the container 11, any substance, whether it is in the form of a liquid or solid, may be similarly employed so far as it is capable of expanding in its volume by heating.

It is also to be noted that, in the embodiment of FIG. 1, the change of state of the substance 10 is not limited to that in the same form of a gas, liquid or solid, but may be so modified as to utilize volume expansion following changes in the form such as a change from liquid to gas, or solid to liquid or the like for achieving the same purpose.

Figure 3:
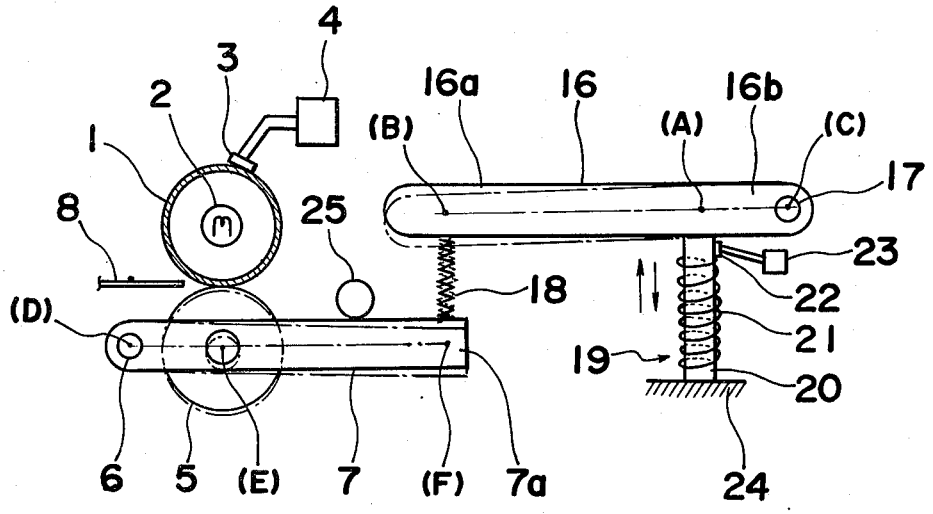
FIG. 3 is a view similar to FIG. 1, which particularly shows a modification thereof.

Reference is further made to FIG. 3 which shows a modification of the arrangement of FIG. 1, and in which like parts in FIG. 1 are designated by like reference numerals for brevity of description. The arrangement of FIG. 3 includes a lever 16 pivotally supported, at its one end **16*b*, by a shaft 17 and coupled, at its other end 16*a*, to the corresponding end portion 7*a* of the pressure roller support plate 7 through a spring 18, and a contact and spacing mechanism 19 according to the present invention utilizing expansion and construction of the object or substance as described earlier with reference to FIG. 1, and further including an expanding and contacting member 20 composed, for example, of an object having a comparatively large coefficient of linear expansion due to heating, for example, substances such as duralumin or the like, a heating element 21 in the form of a coil wound around the expanding and contacting member 20 so as to be energized upon turning-on of the power supply for heating said member 20, a temperature sensor 22 disposed in contact with the expanding and contracting member 20 for detecting the temperature thereof, and a temperature control circuit 23 coupled to the temperature sensor 22 for controlling the temperature of the member 20 detected by the temperature sensor 22 to such a level as will produce a predetermined linear expansion. The expanding and contracting member 20 is secured, at its one end, to a suitable stationary base 24, and is arranged to contact, at its other end, a base portion 16*b* of the lever 16 as shown. Additionally, above the pressure roller support plate 7 in a position adjacent to the end 7*a* thereof, a stopper member 25 is provided to contact the plate 7 for properly adjusting the contact force of the pressure roller 5. In the above embodiment, the temperature control for the fixing roller 1 and the expanding and contracting member 20 in the contact and spacing mechanism 19 is effected generally in a similar manner as that described with reference to FIG. 2**.

By way of example, preferable dimensions for respective parts and contact forces of the pressure roller 5 in the above arrangement of FIG. 3 are given below based on experiments carried out by the present inventors.

(a) Dimensions for respective parts are the following

Distance between points C and B . . . 100 mm
Distance between points C and A . . . 20 mm
Distance between points D and E . . . 20 mm
Distance between points E and F . . . 30 mm.

However, it should be clear that these distances are shown only approximately in FIG. 3 which is obviously not drawn to scale.

(b) Thermal expansion coefficient of duralumin for the expanding and contracting member 20 is represented by $22.6\times10^{-6}$/°C. (at 20° C.). When the member 20 is heated by the heating element 21 up to a temperature of 150° C. as detected by the sensor 22, amounts of displacement at the points A and B are as follows (the original length of the member 20 is set to be 160 mm).

Amount of displacement at the point A is $160\times130\times22.6\times10^{-6}=0.47$ mm.

Amount of displacement at the point B is 0.47 (mm)×5=2.35 mm.

(c) On the assumption that the load applied by the spring 18 is 60 kg, the load at the point E, i.e. contact force of the pressure roller 5 is represented by 60 kg×20 (mm)/(20+30) (mm)=24 kg.

By the above arrangement of FIG. 3, upon turning-on of the power supply, the heating elements 2 and 21 are energized to heat the fixing roller 1 and the expanding and contracting member 20 for raising the temperatures thereof, whereby said member 20 in the contact and spacing mechanism 19 is subjected to linear expansion to push up the lever 16 from the chain-like line position to the solid line position, and thus, the pressure roller support plate 7 is brought into contact with the stopper member 25 through the spring 18, with the pressure roller 5 contacting the fixing roller 1 under a proper contact pressure. In the above state, the temperature of the expanding and contracting member 20 reaches the predetermined level so as to be detected by the temperature sensor 22, and is maintained at such predetermined level through on/off control of the heating element 21 by the temperature control circuit 23.

Meanwhile, the surface temperature of the fixing roller 1 is controlled in a similar manner as in the embodiment of FIGS. 1 and 2, and therefore, the "wait" state continues until both of the temperatures for the fixing roller 1 and the expanding and contracting member 20 reach the predetermined levels.

Upon turning-off of the power supply after fixing of the predetermined number of copy paper sheets 8, both of the heating elements 2 and 21 are de-energized and the expanding and contracting member 20 is cooled so as to be restored to the original state through contraction. Therefore, the lever 16 and pressure roller support plate 7 are returned back to the initial positions indicated by the chain-like lines in FIG. 3, with the pressure roller 5 being spaced from the fixing roller 1.

As is clear from the foregoing description, in the embodiment of FIG. 3, also, the contact and spacing mechanism 19 positively functions, since it is so arranged that the pressure roller 5 is brought into pressure contact with the fixing roller 1 through utilization of linear expansion of the expanding and contracting member 20, while said pressure roller 5 is restored back to the original position by utilizing expansion and contraction of the expanding and contracting member 20.

It should be noted here that, although the above embodiment of FIG. 3 relates to the case where the expansion or contraction of the member 20 in the contact and spacing mechanism 19 is arranged to be transmitted in the pressure roller support plate 7 through the lever 16 and spring 18, the arrangement may be modified, for example, in such a manner that, with the pressure roller 5 journalled at the end portion *7a* of the support plate 7 and the fixing roller 1 disposed in a position corresponding thereto, by providing the expanding and contracting member 20 in the vicinity of the pivotal shaft 6 for said support plate 7, the pressure roller support plate 7 is operated directly by the contact and spacing mechanism 19.

Figure 4:
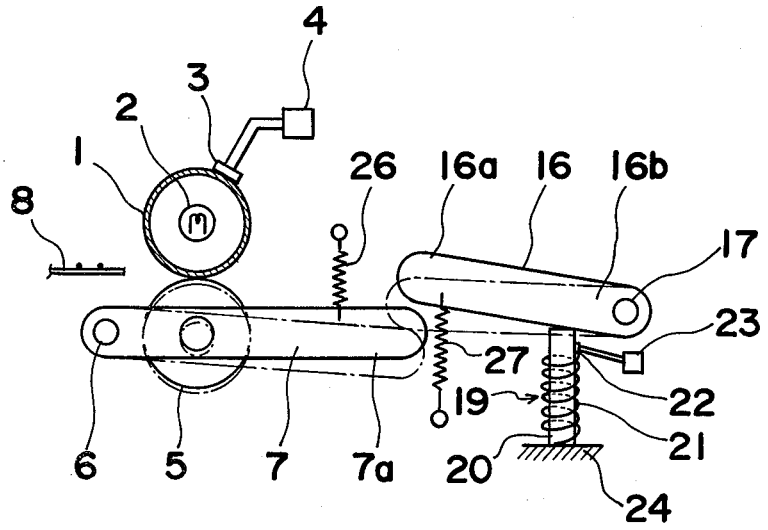
FIG. 4 is a view similar to FIG. 3, which particularly shows a further modification thereof.

Referring further to FIG. 4, there is shown a further modification of the arrangement of FIG. 3, in which like parts in FIG. 3 are also designated by like reference numerals for brevity of description. In this modification in FIG. 4, instead of coupling the lever 16 with the pressure roller support plate 7 through the spring 18 as in FIG. 3, a spring 26 is connected between a fixed point and the end *7a* of the support plate 7 for urging said plate 7 counterclockwise, i.e. in the direction for bringing the pressure roller 5 into pressure contact with the fixing roller 1, while another releasing or spacing spring 27 is connected between the end *16a* of the lever 16 and a corresponding fixed point for biasing said lever 16 counterclockwise by an urging force stronger than that of the spring 26, i.e. in the direction for depressing the end *7a* of the support plate 7 downwardly by the corresponding end *16a* of the lever 16 so as to space the pressure roller 5 from the fixing roller 1. By the above arrangement also, similar functions and effects as in FIG. 3 may be achieved through the contact and spacing mechanism 19.

More specifically, in FIG. 4, upon turning-on of the power supply, the expanding and contracting member 20 of the contact and spacing mechanism 19 is heated by the heating element 21 for linear expansion so as to push up the lever 16 against the urging force of the releasing spring 27 from the position indicated by the chain-like lines to the position denoted by the solid lines, and therefore, the support plate 7 is pivoted in the counterclockwise direction by the action of the spring 26 for bringing the pressure roller 5 into pressure contact with the fixing roller 1. Subsequently, upon turning-off of the power supply, the heating element 21 is de-energized for cooling and contraction of the expanding and contracting member 20, and the lever 16 is rotated counterclockwise by the action of the releasing spring 27 so as to depress downwards, at its end *16a*, the corresponding end *7a* of the support plate 7 from the solid line position to the chain-like line position for spacing the pressure roller 5 from the fixing roller 1.

As is clear from the foregoing description, according to the present invention, since the toner image fixing device of the type in which the pressure roller 5 is adapted to contact or to be spaced from the fixing roller 1, is further provided with the contact and spacing mechanism 19 which produces the contact and spacing functions of the pressure roller 5 through utilization of expansion and contraction of the object or substance 10, the contact and spacing functions between the fixing roller 1 and pressure roller 5 may be still more positively effected as compared with the conventional contact and spacing mechanisms employing clutches and solenoids, etc., through simple construction and facilitated control thereof.

Although the present invention has been fully described by way of example with reference to the accompanying drawings, it is to be noted here that various changes and modifications will be apparent to those skilled in the art. Therefore, unless otherwise indicated that such changes and modifications depart from the scope of the present invention, they should be construed as included therein.

What is claimed is:

1. A toner image fixing device for fixing a toner image carried on a support material onto said support material through heat fusing, which comprises:

a fixing roller provided with heating means therefor, a pressure roller arranged to contact, under pressure, said fixing roller for passing said support material therebetween, a power supply for the heating means, a contact and spacing means for causing said pressure roller selectively to contact or to be spaced from said fixing roller, said contact and spacing means including a member which responds to temperature changes occurring therein through utilization of linear expansion and contraction following turning-on and turning-off of the power supply, a heating element for effecting said linear expansion and contraction, so provided in said contact and spacing means as to be energized upon turning-on of the power supply so as to heat said member for its expansion and to be de-energized upon turning-off of the power supply for allowing the member to be cooled for its contraction, wherein said heating element is provided around said member, a first pivotal lever coupled with said member, a second pivotal lever means for supporting said pressure roller so as to bring said pressure roller into pressure contact with said fixing roller upon expansion of said member and into spacing from said fixing roller upon contraction thereof, spring means for coupling the first pivotal lever with the second pivotal lever means, and a stopper member being provided for contact with said second pivotal lever means so as to adjust contact pressure of said pressure roller with respect to said fixing roller.

2. A toner image fixing device as claimed in claim 1, wherein said contact and spacing means is arranged to function through utilization of linear expansion and contraction of the member having a comparatively large coefficient of linear expansion.

3. A toner image fixing device as claimed in claim 1, wherein said member is in the form of a solid object.

4. A toner image fixing device for fixing a toner image carried on a support material onto said support material through heat fusing, which comprises:

a fixing roller provided with heating means therefor, a pressure roller arranged to contact, under pressure, said fixing roller for passing said support material therebetween, a power supply for the heating means, a contact and spacing means for causing said pressure roller selectively to contact or to be spaced from said fixing roller, said contact and spacing means including a member which responds to temperature changes occurring therein through utilization of linear expansion and contraction following turning-on and turning-off of the power supply, a heating element for effecting said linear expansion and contraction, so provided in said contact and spacing means as to be energized upon turning-on of the power supply so as to heat said member for its expansion and to be de-energized upon turning-off of the power supply for allowing the member to be cooled for its contraction, wherein said heating member is provided around said member, a first pivotal lever coupled with said member, a second pivotal lever which supports said pressure roller, a first spring means for urging the first pivotal lever in a direction to space said pressure roller from said fixing roller through contact of said first pivotal lever with said second pivotal lever, and a second spring means for urging the second pivotal lever in a direction to bring said pressure roller into contact with said fixing roller, said first spring means being adapted to depress said second pivotal lever through said first pivotal lever in said direction to space said pressure roller from said fixing roller, by spring forces larger than the urging force of said second spring means against said second pivotal lever.

5. A toner image fixing device as claimed in claim 4, wherein said contact and spacing means is arranged to function through utilization of linear expansion and contraction of the member having a comparatively large coefficient of linear expansion.

6. A toner image fixing device as claimed in claim 4, wherein said member is in the form of a solid object.

* * * * *